343-700 MS AU 251 EX
10/2/84 OR 4,475,108

United States Patent [19]

Moser

[11] Patent Number: 4,475,108

[45] Date of Patent: Oct. 2, 1984

[54] ELECTRONICALLY TUNABLE MICROSTRIP ANTENNA

[75] Inventor: Kenneth R. Moser, South Bend, Ind.

[73] Assignee: Allied Corporation, Morris Township, Morris County, N.J.

[21] Appl. No.: 405,139

[22] Filed: Aug. 4, 1982

[51] Int. Cl.[3] ..... H01Q 1/38

[52] U.S. Cl. ..... 343/700 MS; 343/830

[58] Field of Search ..... 343/700 MS, 829, 830

[56] References Cited

U.S. PATENT DOCUMENTS

| | | | |
|---|---|---|---|
| 2,996,713 | 8/1961 | Boyer | 343/745 |
| 3,426,352 | 2/1969 | Fenwick | 343/750 |
| 3,680,136 | 7/1972 | Collings | 343/700 MS |
| 3,707,711 | 12/1972 | Cole et al. | 340/572 |
| 3,713,162 | 1/1973 | Munson et al. | 343/705 |
| 3,921,177 | 11/1975 | Munson | 343/846 |
| 3,947,850 | 3/1976 | Kaloi | 343/795 |
| 3,967,276 | 6/1976 | Goubau | 343/752 |
| 3,978,487 | 8/1976 | Kaloi | 343/829 |
| 3,978,488 | 8/1976 | Kaloi | 343/829 |
| 3,984,834 | 10/1976 | Kaloi | 343/700 MS |
| 4,040,060 | 8/1977 | Kaloi | 343/700 MS |
| 4,051,478 | 9/1977 | Kaloi | 343/700 MS |
| 4,053,895 | 10/1977 | Malagisi | 343/700 MS |
| 4,060,810 | 11/1977 | Kerr et al. | 343/700 MS |
| 4,070,676 | 1/1978 | Sanford | 343/700 MS |
| 4,074,270 | 2/1978 | Kaloi | 343/700 MS |
| 4,079,268 | 3/1978 | Fletcher et al. | 343/700 MS |
| 4,089,003 | 5/1978 | Conroy | 343/829 |
| 4,138,684 | 2/1979 | Kerr | 343/846 |
| 4,162,499 | 7/1979 | Jones, Jr. et al. | 343/700 MS |
| 4,163,236 | 7/1979 | Kaloi | 343/700 MS |
| 4,167,010 | 9/1979 | Kerr | 343/700 MS |
| 4,197,544 | 4/1980 | Kaloi | 343/700 MS |
| 4,267,532 | 5/1981 | Saleh | 333/33 |
| 4,319,248 | 3/1982 | Flam | 343/701 |
| 4,320,401 | 3/1982 | Schiavone | 343/700 MS |
| 4,410,891 | 10/1983 | Schaubert et al. | 343/700 MS |

*Primary Examiner*—Eli Lieberman

*Attorney, Agent, or Firm*—William A. Marvin; Anthony F. Cuoco; Stanley N. Protigal

[57] ABSTRACT

A microstrip antenna with a linearly polarized radiating patch is varied in resonant frequency by an electronic tuning technique. A dc bias voltage is combined with the excitation signal to regulate the capacitance of a varactor diode mounted in the antenna structure. In one embodiment the varactor is in shunt with a half wave open circuited radiator and adds electrical length to the antenna, while in another embodiment the varactor is in series with a shorted quarter wave radiator and subtracts electrical length therefrom.

4 Claims, 12 Drawing Figures

ELECTRONICALLY TUNABLE MICROSTRIP ANTENNA

The invention pertains generally to an electronically tunable microstrip antenna and is more particularly directed to a tunable microstrip antenna system utilizing a varactor diode as the tuning element.

The microstrip antenna or radiator used for microwave transmission and receiving is conventionally known in the art to comprise a planar or curved radiating element of a specific shape and size overlaying and separated from a ground plane. The separation is provided by a dielectric sheet or lamina to space the ground plane from the radiating element such that a radiating resonant element is formed. The radiating element is fed or excited from an rf generator by any number of matching and phasing techniques that are all well known to those skilled in the art. The advantages of such microstrip radiators are their small size, their ability to be conformal to a curved surface when formed with a flexible substrate, and the inherent ruggedness of a printed-circuit type construction. These advantages lend themselves to many applications for the microstrip antenna in both military and commercial activities.

However, many prior microstrip antennas, to their detriment, exhibit a very narrow resonance. The operating frequency for a high Q microstrip antenna may only be varied from two to three percent of its center resonant frequency without severe degradation in performance. The resonance frequency is also directly related to the size and shape of the microstrip which places a further restriction on its versatility. The advantages of the microstrip antenna in its multiple applications could be enhanced greatly if a facile method could be developed to broaden its bandwidth while permitting efficient operation at each of a number of chosen resonant frequencies. In the past, this problem has been approached by differing techniques which provide pseudo multiple frequency microstrip antennas.

One approach has been to form the microstrip radiator with two orthogonal dimensions different from one another and therefore resonant at different frequencies. This approach is rather limited in the number of frequencies that can be accommodated and is limited to linear polarization where multiple frequencies are concerned. Furthermore, the linear polarizations of the two frequencies are necessarily different because of the different physical orientation of the resonant dimensions.

Another approach to the multiple resonant microstrip radiator has been to employ different microstrip elements of differing shapes and sizes having the desired resonant frequencies. These separate elements are then arrayed together on a single or multiply layered microstrip board and connected together via microstrip feedlines in a manner to minimize the mutual coupling effects. Such mutual coupling cannot be totally eliminated and thus often results in a significant distortion of the desired radiation patterns. Moreover, the surface area of such multiple resonant structures has in the past precluded their significant use in the larger aperture arrays.

In concert with this approach of having several arrayed elements is a radiator in which a plurality of elements are stacked above a common ground plane. Each element is dimensioned and spaced from the others to resonate at a different frequency with an rf feed attached to at least one of them. During operation, the non-resonant element surfaces provide inductive-capacitive coupling of the rf energy to or from the chosen resonant element surface.

Although these prior art microstrip techniques illustrate an advance over single frequency microstrip antennas, they are still deficient in providing a truly broad band microstrip antenna. A broad band microstrip antenna would be one that may be continuously tuned for receiving or transmitting over a broad range of frequencies without severe degradation in signal strength.

SUMMARY OF THE INVENTION

Therefore, it is an object of the invention to provide a microstrip antenna of a single resonator that is tunable over a broad range of frequencies.

It is another object of the invention to provide a microstrip antenna where the tuning may be accomplished at a remote location from the mounting structure of the antenna.

Still another object of the invention is to provide a remotely tunable structure whose resonant frequency can be varied with facility by an electrical signal.

Accordingly, the invention is an electronically tunable microstrip antenna comprising a non-conducting base element of dielectric material having a front side and a back side, a ground plane formed of a conducting sheet located on the back side of said base, a microstrip radiator formed of a conducting sheet and located on the front side of said base, a dc voltage variable capacitance connected between said radiator and ground which is operable to regulate the electrical length to the microstrip radiator with respect to a dc control voltage to effect a resonance change, a transmission line, means for coupling said transmission line to the microstrip radiator, and means for driving the microstrip radiator with an rf signal voltage and a dc bias voltage through said transmission line.

In the preferred embodiments, the voltage varable capacitance is a reverse biased varactor diode whose capacitance changes as a function of the magnitude of the dc bias voltage. The variable capacitance is used either in series or parallel with a microstrip element to vary the electrical length of the antenna and hence the resonant frequency. A DC open circuited half wave radiator is illustrated with a shunt diode and a DC shorted quarter wave radiator is illustrated with a series diode.

The advantage of this antenna configuration is that it is tunable over a substantial range of frequencies while using only one microstrip radiator. The bias voltage may be varied to provide electrical length (resonance) change for many different purposes such as transmitting on one frequency and to receiving on another. Another advantage is this configuration makes the antenna electronically or remotely tunable so that the bias voltage may be generated separate from the placement of the antenna and then transmitted over the transmission line.

These and other objects, features, and aspects of the invention will be more clearly understood and better described if a reading of the detailed description is undertaken in conjunction with the appended drawings, wherein:

DETAILED DESCRIPTION OF THE PREFERRED EMBODIMENT

Figure 1:
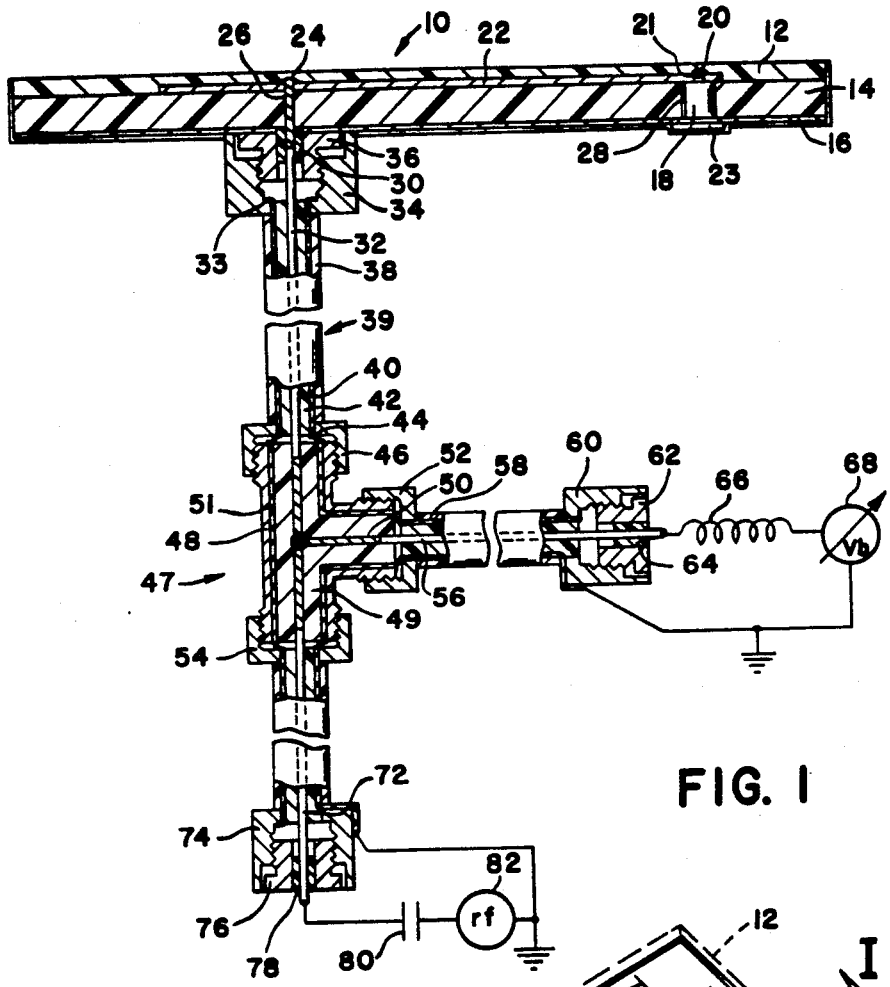
FIG. 1 is a partially cross sectioned side view of a microstrip antenna and its excitation structure which is constructed in accordance with the invention.
Figure 2:
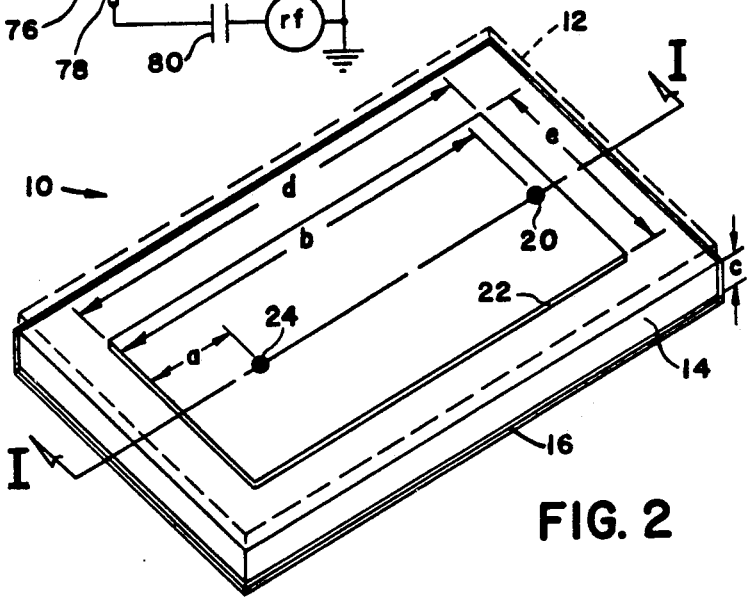
FIG. 2 is a perspective top view of the microstrip antenna illustrated in FIG. 1.

With reference to FIG. 1 and FIG. 2 there is shown a microstrip antenna generally designated 10 constructed in accordance with the teachings of the invention. The microstrip antenna 10 is constructed as a multiple layer device in which a generally rectangular non-conducting base element 14 forms a support portion. The base element 14 is preferably formed from a sheet of dielectric material such as polystyrene, Teflon fiberglass, or the like. One such fiberglass material is commercially available under the trademark DUROID.

On one side of the base element 14, a ground plane is formed by a conducting layer 16. On the other side of the base element 14 is disposed another conducting layer forming a radiating element 22. The ground plane and radiating element may be adhered, sprayed, screened, or vapor deposited on the base as is well known in the art of sheet covering. The conducting lamina are preferably copper foil but can be other materials with excellent conductive properties such as silver, gold, etc. Preferably, the microstrip may be manufactured by taking a dielectric layer such as 14 having conducting layers on both sides (dual clad) and then photo-etching the desired radiating pattern 22 on one side such as is accomplished when manufacturing printed circuit boards. For protection of the conductive surfaces, the antenna may be overlapped with another insulative lamina of polystyrene such as at 12 after manufacture.

If it is desired that the antenna 10 be conformal to a curved surface, then the dielectric 14 would advantageously be flexible. The flexible base permits the antenna to be flush mounted on curved aerodynamic surfaces of carriers such as aircraft or missiles. A conformal mounting of the antenna will not adversely affect the surface of the carriers and allows the antenna to withstand greater stress than if mounted conventionally.

An aperture 28 is provided in the dielectric element 14 in order to mount a varactor diode 18 within the antenna structure. The cathode 21 of the diode is electrically connected to the radiating element 22 by drilling a small hole in the element and thereafter providing a solder point 20. The anode 23 of the diode is flange shaped and contacts the ground plane 16 to provide electrical continuity to that portion of the device. In this configuration the diode 18 is electrically connected in a shunt reversed biased configuration between the radiating element 22 and the ground plane 16.

Figure 11:
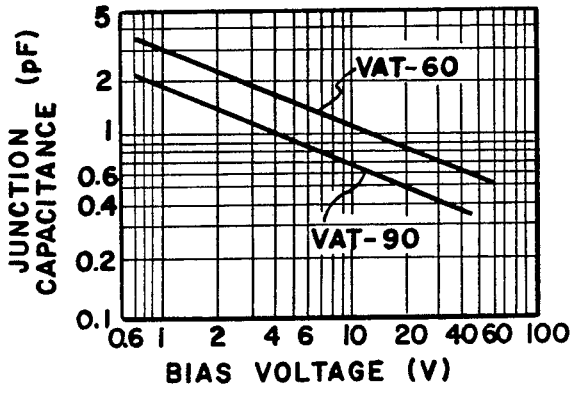
FIG. 11 is a representative graphical illustration of junction capacitance as a function of bias voltage for the varactor diode illustrated in FIGS. 1 and 3.

A varactor diode is a small solid state diode which when reversed biased with a dc voltage (positive potential applied from cathode to anode) varies in capacitance according to the magnitude of the bias. Representative of these devices are the VAT Series of Ceramic packaged tuning diodes commercially available from the Varian Corporation of Palo Alto, Calif. Typical values of junction capacitance for these devices will vary from several tenths of a picofarad to several picofarads for a bias voltage of variation of several volts to one hundred volts. Representative illustrations of these variances are shown in FIG. 11 for the VAT-60, and VAT-90 series of tuning diodes.

At the other end of the longitudinal axis of the radiating element 22 is a feed connection comprising a metalized pin 26 which is passed through the radiating element 22, the dielectric element 14, and the ground plane 16. The metal pin is electrically connected to the radiating element 22 by a solder point 24 but is electrically insulated from the ground plane 16 by an annularly shaped insulator 30. The insulator 30 is mounted within a male connector 36 which is soldered or conductively adhered to the ground plane 16.

The feed connection provides a means for exciting the antenna with a rf signal voltage and further provides a means for connecting the ground plane 16 to ground potential by means of a standard coaxial connector and transmission line 39. A standard coaxial connector coupling 34 is shown as operably coupled to the connector 36 and which is further electrically connected to the braided shield portion 40 of the coaxial transmission line. The transmission line 39 comprises, as is known to those skilled in the art, a center signal conductor 32 which is surrounded by a layer of dielectric material 42 wrapped by the braided shield 40. The transmission line may or may not include an outer cover 38 which protects the shield and signal conductor from ambient conditions.

The transmission line 39 connects at its other end to a conventional coaxial T connector generally designated 47. The T connector 47 comprises generally a inner signal conductor 50 generally of a T shape in cross section which is overlayered by dielectric material 49 which again has a braided shield 51 covering its outside. The entire T connector is protected by a metal outer shell 48 which forms three male connections for signal mixing.

The first male connector is mated with the coupling 46 of the transmission line such that the signal conductor 32 is electrically connected to the signal conductor 50. A second male connector is operably mated with a coupling 52 such that a coax signal conductor 56 is electrically connected to the common conductor 50.

Similarly, the third male connector is operably mated with a coupling 54 such that a signal conductor 72 is electrically connected to the common conductor 50.

The electrical conductor 56 is the central conductor of a second coaxial transmission line which receives a signal from a variable dc bias source 68 through an inductor 66. The ground terminal of the bias source 68 is connected to the shield 58 to produce a ground potential to the shield of the T connector and first transmission line for the ground plane 16. The inductor 66 serves as an rf choke to limit any rf energy from passing to or from the dc bias source 68.

The signal conductor 72 is the central conductor of a third transmission line which terminates through capacitor 80 to a radio frequency source 82. The ground terminal to the rf source 82 is connected to the shield 70 of the third transmission line and therefore to the ground potential of the ground plane 16 through the shield of the first transmission line and shield of the T connector. The capacitor 80 serves as a blocking capacitor to limit any dc energy from passing to or from the rf source 82.

This structure provides an rf excitation signal to the radiating element 22, a reverse dc bias to the varactor diode 18, and a ground potential to the ground plane 16. It is evident that the rf source 82 could additionally be replaced by a receiver for demodulating or detecting rf energy from the antenna 10.

Figure 9:
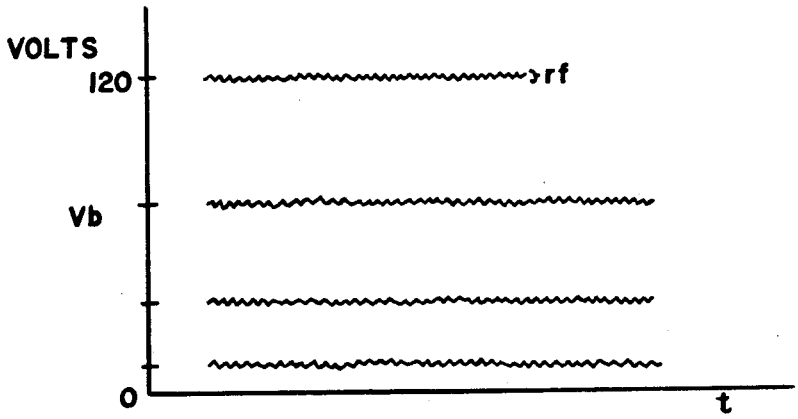
FIG. 9 is a graphical representation of the combination of the excitation and bias signals provided for the antenna illustrated in FIGS. 1 and 3.

In operation, the T coupling combines the rf signal and the dc bias for transmission to the antenna by transmission line 39. Representative combined waveforms for the mixed signals are illustrated in FIG. 9 where the bias voltage Vb is shown combined with the rf signal. The bias voltage can vary from zero to approximately one hundred volts while the rf signal is on the order of several hundred millivolts. Dependupon the polarization of the diode, the bias Vb can either be positive or negative to reverse bias the diode. The combining of the rf signal with the dc bias signal allows the generator 68 to be remotely located from the antenna structure 10. Thus, the antenna can be electronically tuned by the bias signal through the transmission line.

With respect now to FIG. 2 the dimensioning of the antenna will now be more fully discussed. Initially, it is noted that the feed point 24 and the varactor connection 20 are provided along the longitudinal axis of the radiating element 22. This central location for the feed point 24 provides a linear polarization of the transmitted energy along that direction. The initial resonant frequency of this type of antenna is determined by the length dimension (d) of the radiator 22 and is nominally one half wavelength. The width dimension (e) of the radiator 22 may vary considerably, but to a first order does not materially affect the resonant frequency if symetrical about the longitudinal axis. As is known, the feed point dimension (a) which indicates the distance of the feed point 24 from the initial edge of the radiator 22 determines the impedance match of the system to the transmission line. This dimension may be varied to provide the desired impedance usually on the order of 50 ohms for matching of the transmission line to the radiator. The dimension (b) which indicates the distance of the connection of the varactor diode from the driven edge of the radiator 22 should be positioned for equivalent parallel resonance to provide maximum tuning bandwidth from a given diode. The dielectric width (c) may vary considerably in thickness but it has been found that broader instantaneous bandwidths can be obtained with larger thicknesses of dielectric. However, the thickness (c) should be much less than a half wavelength.

In the configuration illustrated, the antenna is illustrated as a half wave open circuited antenna which radiates from out-of-phase fields coupling to the ground plane at the edges transverse to the longitudinal axis. The antenna is linearly polarized in the direction of the longitudinal axis having a basic resonance at a frequency, fo, corresponding to a wavelength $\lambda$ of twice distance (d). The basic resonance frequency, fo, is then given by the equation $fo = V/\lambda$ where V is the velocity of light in free space.

Figure 5:
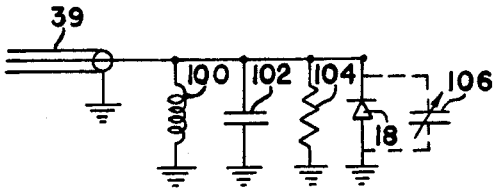
FIG. 5 is a lumped element electrical equivalent of the microstrip antenna illustrated in FIG. 1.

A lumped element electrical equivalent of the antenna thus formed is shown in FIG. 5 where the transmission line 39 is shown driving the parallel configuration of an inductor 100, a capacitor 102, a radiation resistance 104, and the varactor diode 18. The reactances 100, 102 and radiation resistance 104 represents the impedance behavior of the radiating element as viewed from the feed point. The variable capacitance of the varactor diode is represented by the dotted addition of variable capacitor 106.

Figure 6:
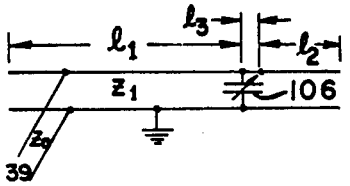
FIG. 6 is a pictorial representation of the variances in electrical length of the microstrip antenna illustrated in FIG. 1.

A diagram of the electrical length of such an antenna configuration represented by an open circuited transmission line is illustrated in FIG. 6. It is known that the electrical length is what determines the resonant frequency of an antenna and not its actual physical length. Initially, the half wave length antenna illustrated in FIGS. 1 and 2 and electrically shown in FIG. 5 is a basic electrical length L1. This is a function of the size and shape of the radiating element 22 and the impedance matching of the transmission line 39. By adding the variable capacitance 106 the electrical length may be changed by a factor L2 which, because the capacitor is in parallel, adds to the electrical length of the basic measurement. The additional length L2 can be varied from a minimum at point 110 to a maximum value at 114 by varying the bias voltage on the varactor 18 from a zero dc bias to VB(Max). Because the varactor 18 has a negative slope, the maximum length of the antenna will be when the bias voltage is zero with a maximum capacitance for the varactor 18 and the electrical length will be a minimum when the bias voltage is at VB(Max) where the varactor has a minimum capacitance. To achieve the optimum match for the variable tuning range, the position of transmission line 39 should be determined for a best match at a biased capacitance corresponding to the electrical length at one half of L2—the equivalent line length at the center of the tuning range.

Figure 12:
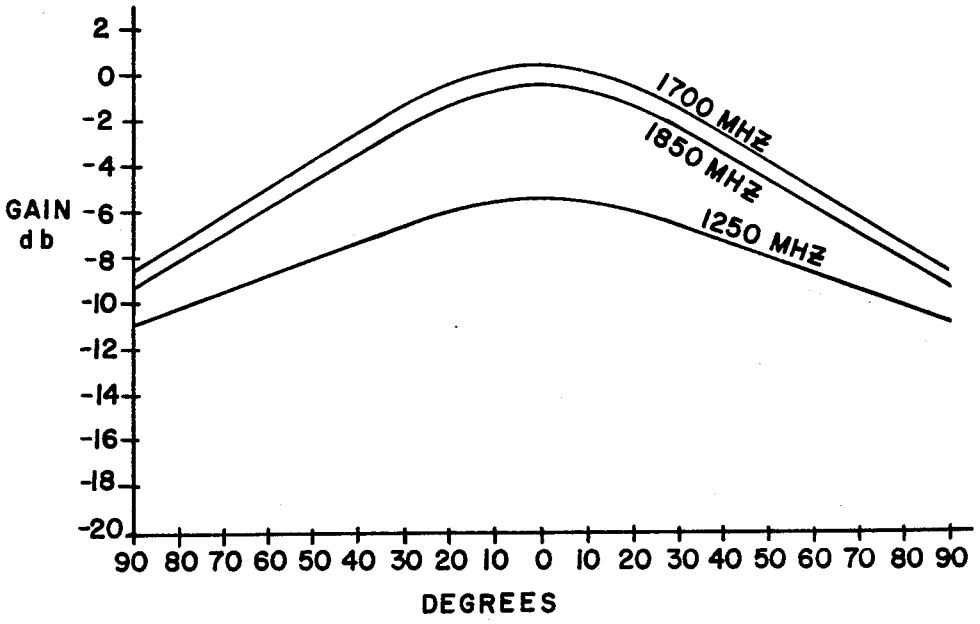
FIG. 12 is a graphical illustration of gain as a function of angle deviation in the H-Plane for a typical microstrip antenna constructed similarly to the one illustrated in FIG. 1.
Figure 10:
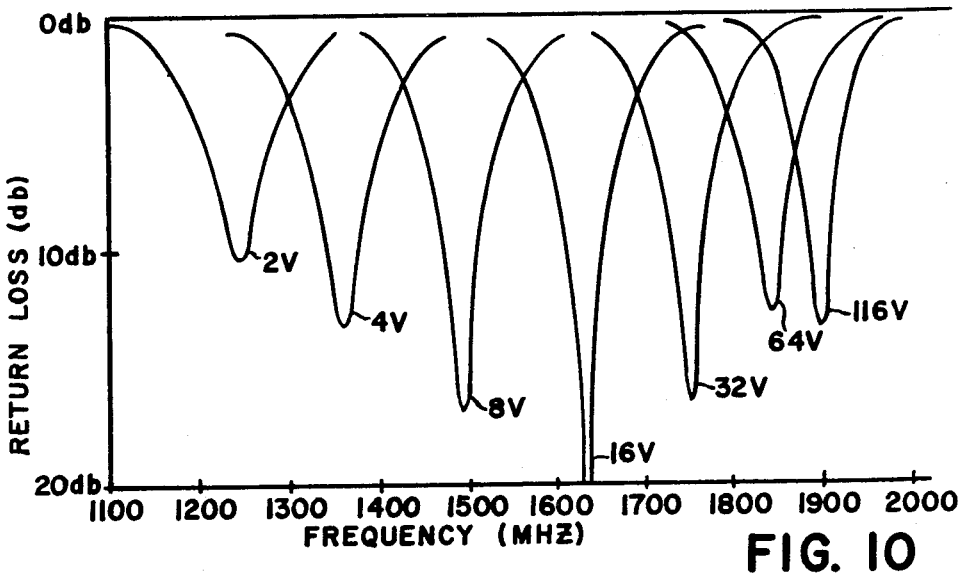
FIG. 10 is a pictorial representation of return loss as a function of frequency and differing bias voltages for a typical microstrip antenna constructed similarly to the one illustrated in FIG. 1.

In FIG. 10 a family of return loss curves as a function of frequency have been plotted for an antenna of similar construction to that of FIG. 1. It is seen that by varying the bias voltage from two to one hundred sixteen volts, the resonance and hence frequency of the antenna has been varied from 1200 MHZ to 1900 MHZ, a tuning bandwidth of nearly 700 MHZ. A gain plot in db (referenced a linearly polarized isotropic radiator) for the same antenna is illustrated in FIG. 12. The angle deviation of the gain is from normal to the antenna surface for a bisection of the H-Plane.

Figure 3:
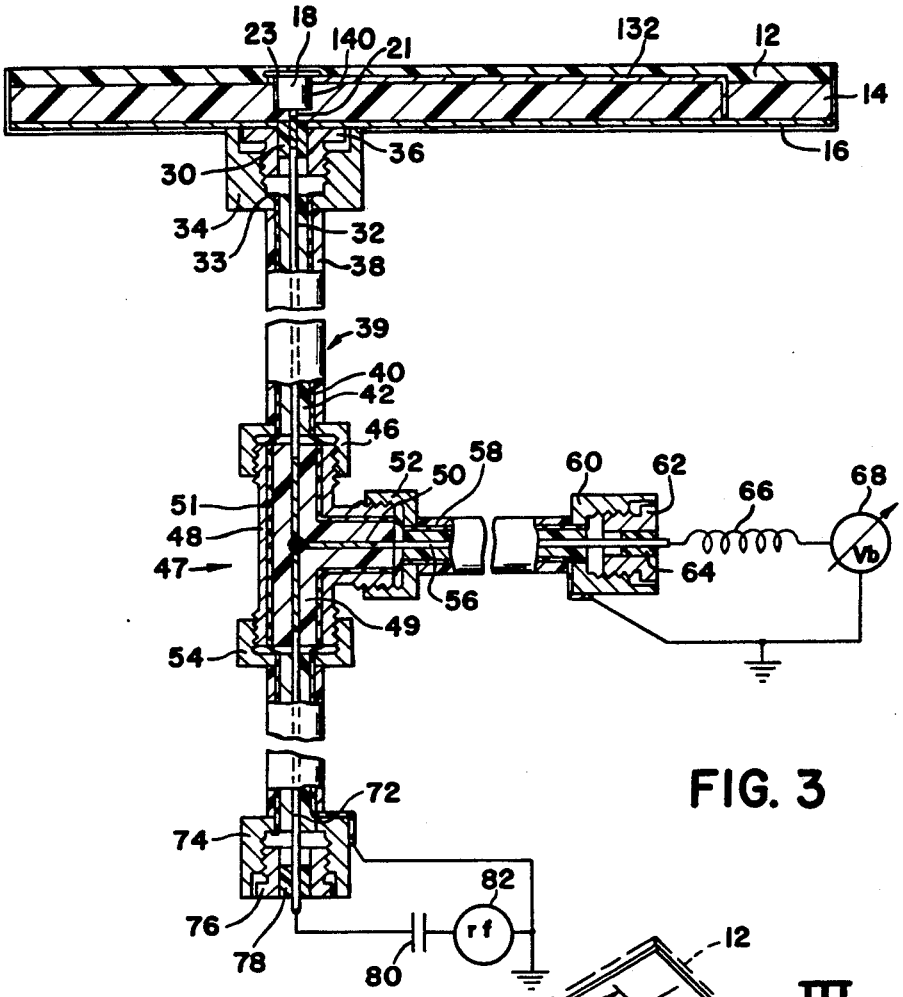
FIG. 3 is a partially cross-sectioned side view of a second embodiment of a microstrip antenna and its excitation structure which is constructed in accordance with the invention.
Figure 4:
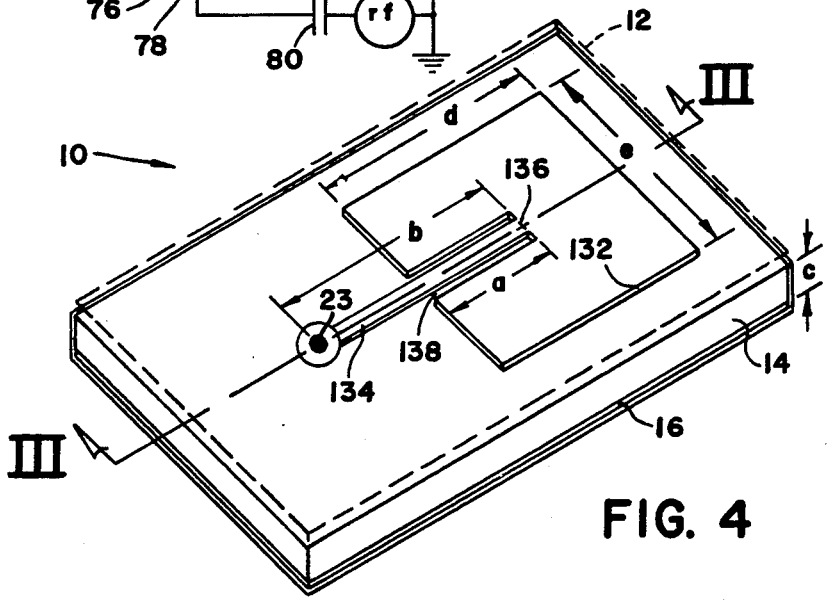
FIG. 4 is a perspective top view of the microstrip antenna illustrated in FIG. 3.

In FIGS. 3 and 4 there is shown a second embodiment of the invention where a shorter quarter wavelength microstrip antenna is illustrated and a series connected varactor diode is used to tune the structure. For the purpose of clarity, similar reference numerals will be used for identical elements of the antenna system as that illustrated in FIGS. 1 and 2.

A quarter wave antenna for the second embodiment is provided by a radiator 132 a quarter wavelength (d) in size shorted at its edge opposite a driven side. The driven side includes a notch 138 providing entry along the central axis of the radiator 132 to a feedpoint 136. The feedpoint 136 is connected to an excitation point consisting of the anode 23 of a varactor diode 18 by a quarter wave microstrip transformer 134. The transformer properties of the quarter wave line 134 are used to mount the series tuning element (varactor 18) at a position where the resonannt element 132 appears as a series tuned circuit.

The serial connection of the varactor 18 is provided by drilling an aperture 140 at the excitation point and then mounting the diode 18 such that the flange-shaped anode 23 is electrically connected to the microstrip transformer 134. The cathode 21 is then connected by a connecting pin 140 to the signal conductor 32 of the transmission line 38. In this manner the varactor 18 is connected in a series reversed biased configuration between the transmission line 38 and the radiating element 22.

With respect to FIG. 4, it is seen that the dimensional analysis for the manufacture of the antenna is similar to that described for the embodiment in FIGS. 1 and 2. The feed point 136 is located along the longitudinal axis and can be varied from the edge by distance (a) to produce an impedance match for the system. The matching transformer length (b) is preferably that to produce the quarter wavelength response indicated. Distances (e) and (c) are varied similar to produce the results indicated for the first embodiment.

Figure 7:
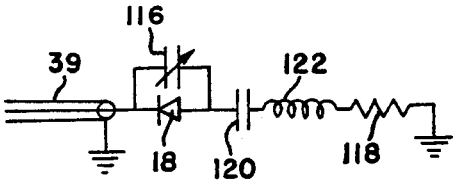
FIG. 7 is a lumped element electrical equivalent view of the microstrip antenna illustrated in FIG. 3.

A lumped element electrical equivalent more fully showing the second embodiment is illustrated by FIG. 7 where the transmission line 39 feeds the series connection of the diode 18, a capacitor 120, an inductor 122, and a radiation resistance 118. The variable capacitance 116 shown as dotted in parallel with the diode 18 indicates its variation in capacitance with respect to the bias Vb. The series connection of the reactances 120, 122, and radiation resistance 118 represent the lumped equivalent impedance behavior of the radiating element 132 and microstrip transformer 134 as viewed from the excitation point 23.

Figure 8:
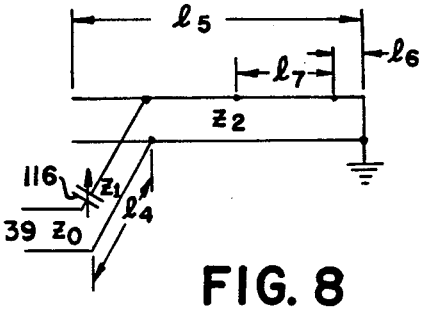
FIG. 8 is a pictorial representation of the variances in electrical length of the microstrip antenna illustrated in FIG. 3.

In FIG. 8 a representation of the electrical length of the second embodiment is shown for the quarter wave structure. At the initial analysis, the quarter wavelength of the antenna is electrical length L5. This is a function of the size and shape of the radiating element 132 and the impedance match of the transmission line 39. When the series capacitance 116 is combined with the length L5 it produces a subtraction of electrical length from a minimum to a maximum. The maximum length that can be subtracted from the antenna is L7 where the capacitance is greatest and the minimum length that can be subtracted is L6 where the bias voltage VB is maximum and a minimum capacitance occurs. Preferably the antenna is matched, as was noted before, at a frequency midway between the variations of electrical length. Thus, it is shown that a quarter wave length antenna that can be varied from an electrical length of L3–L6 to an electrical length of L3–L7 has been provided.

It is noted that the series diode implementation of the invention has been illustrated with the shorted quarter wave antenna embodiment but it should be evident that this configuration could additionally be used with the first embodiment of an open circuited half wave antenna.

While the preferred embodiments of the invention have been shown and described, it will be obvious to those skilled in the art that various modifications and variations may be made thereto without departing from the spirit and scope of the invention as defined hereinafter in the appended claims. For example, in the embodiments illustrated, a square or rectangular patch element has been disclosed. It is within the skill of the art to use other shaped radiators such as ellipses, circles, pentagons, etc., and/or other polarization techniques such as circular, with the invention.

What is claimed is:

1. An antenna structure comprising:

a generally rectangular microstrip radiator having a nominal physical length of one half of the wavelength of a desired resonant frequency, and a grond plane spaced from said radiator by a dielectric lamina with a thickness much less than said wavelength;

a varactor diode, electrically connected between said ground plane and said radiating element, located at one extreme of the longitudinal axis of the radiating element;

a feed pin, electrically connected to said radiator, located at the other extreme of the longitudinal axis of the radiating element;

a transmission line with a signal conductor electrically connected to said feed pin;

means for generating a variable dc bias voltage with which to reverse bias said diode;

means for generating a rf signal voltage with which to excite said radiating element; and means, electrically connected to said signal conductor, for combining said rf signal and said dc bias voltage for transmission over said transmission line.

2. An antenna structure as defined in claim 1 wherein:

said feed pin is varied in location along said longitudinal axis to match the impedance of said radiator with said transmission line.

3. An antenna structure as defined in claim 2 wherein:

said dc bias voltage causes an addition of electrical length by regulating the capacitance of said diode according to the magnitude of the bias voltage.

4. An antenna structure as defined in claim 3 wherein:

said feed pin is located along the longitudinal axis of the radiator so as to impedance match the midpoint of the variance in electrical length caused by said diode.

* * * * *